US012496481B2

(12) United States Patent
Ren

(10) Patent No.: US 12,496,481 B2
(45) Date of Patent: Dec. 16, 2025

(54) RESISTANCE DEVICE AND PULL ROPE TYPE STRENGTH TRAINING WEIGHT MODULE

(71) Applicant: Xiamen Renhe Sports Equipment Co.,Ltd., Fujian (CN)

(72) Inventor: Yangjie Ren, Fujian (CN)

(73) Assignee: Xiamen Renhe Sports Equipment Co., Ltd., Fujian (CN)

( * ) Notice: Subject to any disclaimer, the term of this patent is extended or adjusted under 35 U.S.C. 154(b) by 184 days.

(21) Appl. No.: 18/583,780

(22) Filed: Feb. 21, 2024

(65) Prior Publication Data

US 2025/0205540 A1 Jun. 26, 2025

(30) Foreign Application Priority Data

Dec. 22, 2023 (CN) ..... 202323524926.4

(51) Int. Cl.
*A63B 21/005* (2006.01)
*A63B 21/00* (2006.01)
*A63B 24/00* (2006.01)

(52) U.S. Cl.
CPC ..... *A63B 21/0058* (2013.01); *A63B 21/153* (2013.01); *A63B 24/0087* (2013.01)

(58) Field of Classification Search
CPC ..... A63B 21/0058; A63B 21/153
See application file for complete search history.

(56) References Cited

U.S. PATENT DOCUMENTS 4,779,866 A * 10/1988 Marshall ..... A63B 21/00069 482/116
8,093,731 B2 * 1/2012 Bulthaup ..... H02K 7/1853 290/1 R
8,845,499 B1 * 9/2014 Boatwright ..... A63B 24/0062 482/116
2003/0013585 A1 * 1/2003 Chen ..... A63B 21/153 482/115
2003/0087735 A1 * 5/2003 Chen ..... A63B 21/153 482/115
2022/0305320 A1 * 9/2022 Wang ..... A63B 24/0087
2023/0381573 A1 * 11/2023 Hsu ..... A63B 23/0211
2025/0161735 A1 * 5/2025 Mehtälä ..... A63B 21/153

FOREIGN PATENT DOCUMENTS

CN 112402891 A * 2/2021 ..... A63B 23/12
CN 115645821 1/2023
WO WO-2010121337 A1 * 10/2010 ..... A63B 23/03508

* cited by examiner

*Primary Examiner* — Joshua T Kennedy
(74) *Attorney, Agent, or Firm* — JCIPRNET

(57) ABSTRACT

The present disclosure relates to a resistance device and a pull rope type strength training weight module. The resistance device includes a cord reel, a fixed shaft, a coil spring, a disk motor, and a connector. The disk motor includes a stator and a rotor. The connector is connected to the cord reel and the rotor. The connector prevents the cord reel from rotating forward relative to the rotor and allows the cord reel to rotate reversely relative to the rotor. The disk motor and the cord reel are stacked in an axial direction, which can reduce an occupied space. In a band coiling process, the stator does not need to drive the rotor to rotate reversely. Even if a power failure occurs, band coiling can still be achieved by an elastic potential energy released by the coil spring.

20 Claims, 3 Drawing Sheets

RESISTANCE DEVICE AND PULL ROPE TYPE STRENGTH TRAINING WEIGHT MODULE

CROSS-REFERENCE TO RELATED APPLICATION

This application claims the priority benefit of Chinese application serial no. 202323524926.4, filed on Dec. 22, 2023. The entirety of the above-mentioned patent application is hereby incorporated by reference herein and made a part of this specification.

TECHNICAL FIELD

The present disclosure relates to the field of exercise equipment, and in particular, to a resistance device and a pull rope type strength training weight module.

BACKGROUND

At present, most pull rope type strength training aids used for fitness adjust a stretching force in a way of adding or removing weights. Due to the way of adding or removing the weights, the training aid itself has a heavy weight and occupies a large area, and the way is not flexible. Therefore, some manufacturers have started to use servo motors to replace the weights recently. The stretching force can be flexibly controlled by adjusting a size of a current. This way adapts to different training modes.

Among the methods using the servo motor at present, a mainstream solution is as follows: A cord reel and a servo motor are arranged side by side. The cord reel is connected to a rotor of the servo motor through belt drive; a pull rope is wound on the cord reel; a stretching force of the pull rope drives the cord reel to drive the rotor to rotate through the belt drive; and a stator of the servo motor generates a resistance to reverse rotation of the rotor. When the stretching force of the pull rope disappears, the stator drives the rotor to drive the cord reel to rotate reversely through the belt drive, thus coiling the band. However, the cord reel and the servo motor which are arranged side by side need to occupy a large space, so the volume is large. Furthermore, although the stator drives the rotor to rotate reversely when the resistance is generated, the rotor will rotate forward under the action of the stretching force of the pull rope, and the rotor will rotate reversely during the coiling of the pull rope. This means that the rotor has two working conditions: forward rotation and reverse rotation, which will to some extent affect the service life of the motor. In addition, if the motor is powered off during the coiling of the pull rope, the rope coiling function will fail, and pedestrians trip over the exposed pull rope easily.

Chinese patent No. CN115645821A provides an ultra-thin loading motor for a strength training station, which adopts a solution of stacking a disk motor and a cord reel in an axial direction, and does not use belt drive. The disk motor and the cord reel are connected into a whole. Although the space occupied is reduced, the problem that the rotor has two working conditions: forward rotation and reverse rotation, and the problem that band coiling cannot be achieved if the motor is powered off still have not been solved.

SUMMARY

The present disclosure aims to provide a resistance device and a pull rope type strength training weight module. A space occupied by the resistance device is reduced, the service life of a disk motor is prolonged, and band coiling can also be achieved in case of a power failure.

In order to solve the above technical problems, the present disclosure adopts the following technical solutions:

The present disclosure provides a resistance device, including: a cord reel, wherein an accommodating slot is arranged in the cord reel, and the cord reel is configured to wind cord; a fixed shaft, arranged in the accommodating slot, and the fixed shaft is fixedly arranged; a coil spring, arranged in the accommodating slot and surrounding the fixed shaft, wherein one end of the coil spring is connected to the cord reel, and the other end of the coil spring is connected to the fixed shaft; a disk motor, arranged on one axial side of the cord reel, and the disk motor includes a stator and a rotor; and a connector, connected to the cord reel and the rotor, wherein the connector prevents the cord reel from rotating forward relative to the rotor and allows the cord reel to rotate reversely relative to the rotor.

In some embodiments of the present disclosure, the connector is a one-way bearing.

In some embodiments of the present disclosure, the rotor includes a first mounting part, and a first mounting groove is arranged on the first mounting part; the one-way bearing is arranged in the first mounting groove, and an outer ring of the one-way bearing can rotate synchronously with the rotor; the resistance device further includes a rotating shaft; the rotating shaft is fixedly connected to one side of the cord reel close to the disk motor; and the rotating shaft is inserted into an inner ring of the one-way bearing and can rotate synchronously with the inner ring of the one-way bearing.

In some embodiments of the present disclosure, the rotating shaft is a stepped shaft; the resistance device further includes a first clamping plate; the first clamping plate is detachably connected to one side of the stepped shaft away from the cord reel, and the inner ring of the one-way bearing is clamped between the first clamping plate and a step surface of the rotating shaft; the first mounting part includes a first ferrule and a first supporting ring; the first ferrule is internally provided with the first mounting groove; the first supporting ring is connected to one side of the first ferrule away from the cord reel; the resistance device further includes a first clamping ring; and the first clamping ring is detachably connected to one side of the first ferrule close to the cord reel, and the outer ring of the one-way bearing is clamped between the first clamping ring and the first supporting ring.

In some embodiments of the present disclosure, the resistance device further includes a rotary bearing; the rotary bearing sleeves the first mounting part, and an inner ring of the rotary bearing can rotate synchronously with the first mounting part; the stator includes a second mounting part, and the second mounting part is internally provided with a second mounting groove; the second mounting part sleeves the rotary bearing through the second mounting groove; and the second mounting part can rotate synchronously with an outer ring of the rotary bearing.

In some embodiments of the present disclosure, the rotor further includes a main body part; the main body part is connected to one side of the first mounting part close to the cord reel; the resistance device further includes a second clamping ring and a second clamping plate; the second clamping ring sleeves the first mounting part and is supported on the main body part; the second clamping plate is detachably connected to one side of the first mounting part away from the cord reel, and the inner ring of the rotary bearing is clamped between the second clamping plate and the second clamping ring; the second mounting part includes a second ferrule and a second supporting ring; the second ferrule is internally provided with the second mounting groove; the second supporting ring is connected to one side of the second ferrule close to the cord reel; the resistance device further includes a third clamping plate; the third clamping plate is detachably connected to one side of the second ferrule away from the cord reel; and the outer ring of the rotary bearing is clamped between the third clamping plate and the second supporting ring.

In some embodiments of the present disclosure, the accommodating slot has an opening on one side away from the disk motor; the resistance device further includes a cover plate; and the cover plate is covered at the opening of the accommodating slot and is detachably connected to the cord reel.

In some embodiments of the present disclosure, the resistance device further includes two smooth sheets; the smooth sheets are arranged in the accommodating slot; the smooth sheets are provided two, and respectively arranged on two axial sides of the coil spring.

The present disclosure further provides a pull rope type strength training weight module, including the resistance device according to any one of the above embodiments.

In some embodiments of the present disclosure, the pull rope type strength training weight module further includes a control module, an acquisition module, and a communication module; the control module is configured to control the disk motor; the acquisition module is configured to acquire motion data; and the communication module is in signal connection to the control module and the acquisition module, and is configured to establish communication with an intelligent terminal.

Through the above technical solutions, it can be found that the embodiments of the present disclosure have at least the following advantages and beneficial effects:

In the resistance device of the embodiments of the present disclosure, the disk motor is arranged on the axial side of the cord reel, that is, the disk motor and the cord reel are stacked in the axial direction, so that the space occupied can be reduced, and the disk motor can be made larger and designed with more resistance gears. When a pull rope is pulled, a stretching force of the pull rope causes the cord reel to rotate forward, and the pull rope is released from the cord reel. Since the connector can prevent the cord reel from rotating forward relative to the rotor, the rotor can rotate forward synchronously with the cord reel under the action of the connector. The stator provides a resistance to reverse rotation of the rotor, and the resistance can be adjusted by changing a current of the disk motor. With the forward rotation of the cord reel, the fixed shaft is fixedly arranged, so that the coil spring is curled to store clastic potential energy.

When the stretching force of the pull rope disappears, the coil spring releases the elastic potential energy to cause the cord reel to rotate reversely. The pull rope is wound on the cord reel to achieve band coiling. Since the connector allows the cord reel to rotate reversely relative to the rotor, the rotor will not be driven by the cord reel to rotate reversely. The rotor only needs to have a working condition of forward rotation, which prolongs the service life of the disk motor. Furthermore, in a band coiling process, the stator does not need to drive the rotor to rotate reversely. Even if a power failure occurs, the band coiling can still be achieved by the elastic potential energy released by the coil spring.

In the pull rope type strength training weight module according to the embodiments of the present disclosure, a space occupied by the resistance device can be reduced, the service life of the disk motor can be prolonged, and the band coiling can also be achieved in case of a power failure.

The pull rope type strength training weight module in the embodiments of the present disclosure can be assembled on a pull rope type strength training aid and replaces a traditional counterweight. A resistance value of the pull rope can be adjusted by changing a torsion of the disk motor, and the resistance value can be infinitely adjusted, making the adjustment more flexible and precise. The problems of insufficient flexibility in resistance adjustment and inability to finely adjust the resistance value due to a fixed weight of each traditional counterweight are solved.

BRIEF DESCRIPTION OF THE DRAWINGS

By considering the following detailed explanation of the preferred implementations of the present disclosure in conjunction with the accompanying drawings, various objectives, features, and advantages of the present disclosure will become more apparent. The accompanying diagrams are only exemplary illustrations of the present disclosure and may not necessarily be drawn to scale. In the accompanying drawings, identical reference numerals represent identical or similar components. Where.

Figure 1:
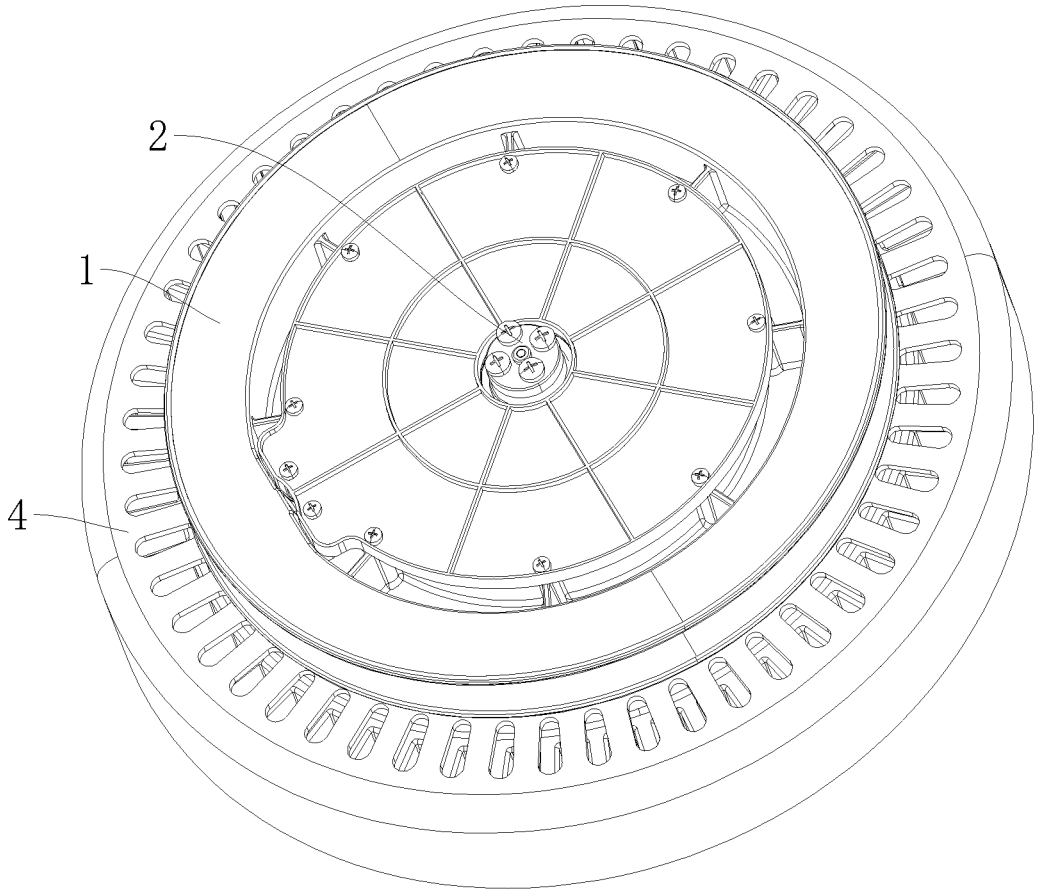
FIG. 1 is a schematic structural diagram of a resistance device according to an embodiment of the present disclosure.

Explanation of reference numerals are as follows: 1: cord reel; 11: winding ring; 111: winding slot; 12: cord reel body; 2: fixed shaft; 3: coil spring; 4: disk motor; 41: stator; 411: second mounting part; 4111: second ferrule; 4112: second supporting ring; 42: rotor; 421: first mounting part; 4211: first ferrule; 4212: first supporting ring; 422: main body part; 423: mounting ring; 5: connector; 61: cover plate; 62: first clamping plate; 63: first clamping ring; 64: second clamping ring; 65: second clamping plate; 66: third clamping plate; 7: smooth sheet; 8: rotary bearing; and 9: encoder.

DETAILED DESCRIPTION OF THE EMBODIMENTS

Although the present disclosure can be easily manifested in different forms of embodiments, only some specific embodiments are shown in the accompanying drawings and will be explained in detail in this specification. Meanwhile, it can be understood that this specification should be regarded as an exemplary explanation of the principle of the present disclosure, rather than being intended to limit the present disclosure to what is explained here.

Therefore, a feature pointed out in this specification will be used to explain one of the features of an embodiment of the present disclosure, rather than implying that each embodiment of the present disclosure needs to have the described feature. Furthermore, it should be noted that this specification describes many features. Although some features can be combined to demonstrate possible system designs, these features can also be used for other combinations that are not explicitly stated. Therefore, unless otherwise specified, the combination described is not intended for limitation.

In the embodiments shown in the drawings, directional indications (such as up, down, left, right, front, and back) are used to explain that the structures and motions of various components of the present disclosure are not absolute but relative. When these components are in positions shown in the accompanying drawings, these explanations are appropriate. If the explanations for the positions of these components change, the indications for these directions also change correspondingly.

Referring to FIG. 1 to FIG. 5, a resistance device according to an embodiment of the present disclosure includes a cord reel 1, a fixed shaft 2, a coil spring 3, a disk motor 4, and a connector 5.

An accommodating slot is arranged in the cord reel 1, and the cord reel 1 is configured to wind cord. The fixed shaft 2 is arranged in the accommodating slot, and the fixed shaft 2 is fixedly arranged. The coil spring 3 is arranged in the accommodating slot and surrounds the fixed shaft 2. One end of the coil spring 3 is connected to the cord reel 1, and the other end of the coil spring 3 is connected to the fixed shaft 2. The disk motor 4 is arranged on one axial side of the cord reel 1, and includes a stator 41 and a rotor 42. The connector 5 is connected to the cord reel 1 and the rotor 42. The connector 5 prevents the cord reel 1 from rotating forward relative to the rotor 42 and allows the cord reel 1 to rotate reversely relative to the rotor 42.

The disk motor 4 is arranged on the axial side of the cord reel 1, that is, the disk motor 4 and the cord reel 1 are stacked in the axial direction, so that the space occupied can be reduced, and the disk motor 4 can be made larger and designed with more resistance gears. When a pull rope is pulled, a stretching force of the pull rope causes the cord reel 1 to rotate forward, and the pull rope is released from the cord reel 1. Since the connector 5 can prevent the cord reel 1 from rotating forward relative to the rotor 42, the rotor 42 can rotate forward synchronously with the cord reel 1 under the action of the connector 5. The stator 41 provides a resistance to reverse rotation of the rotor 42, and the resistance can be adjusted by changing a current of the disk motor 4. With the forward rotation of the cord reel 1, the fixed shaft 2 is fixedly arranged, so that the coil spring 3 is curled to store elastic potential energy.

When the stretching force of the pull rope disappears, the coil spring 3 releases the elastic potential energy to cause the cord reel 1 to rotate reversely. The pull rope is wound on the cord reel 1 to achieve band coiling. Since the connector 5 allows the cord reel 1 to rotate reversely relative to the rotor 42, the rotor 42 will not be driven by the cord reel 1 to rotate reversely. The rotor 42 only needs to have a working condition of forward rotation, which prolongs the service life of the disk motor 4. Furthermore, in a band coiling process, the stator 41 does not need to drive the rotor 42 to rotate reversely. Even if a power failure occurs, the band coiling can still be achieved by the elastic potential energy released by the coil spring 3.

The fixed arrangement of the fixed shaft 2 can be that the fixed shaft 2 is fixedly connected to a stand of a pull rope type strength training aid using the resistance device.

Figure 2:
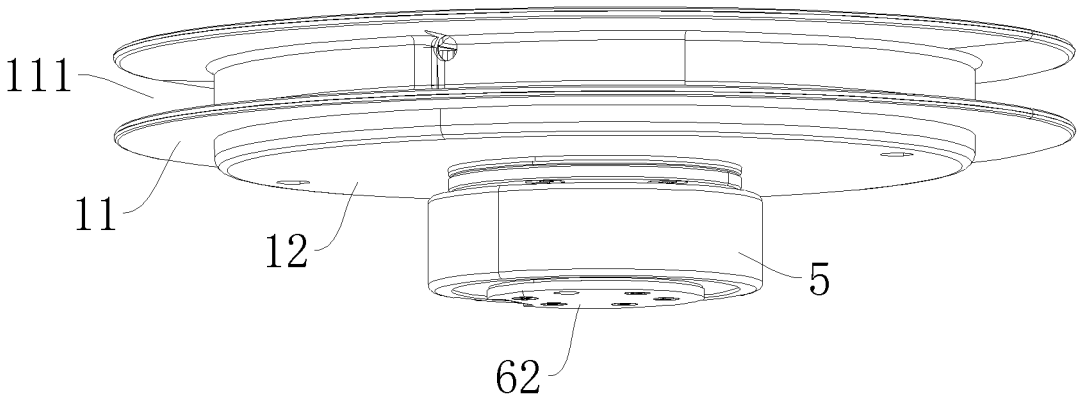
FIG. 2 is a schematic structural diagram of a cord reel part in FIG. 1.
Figure 5:
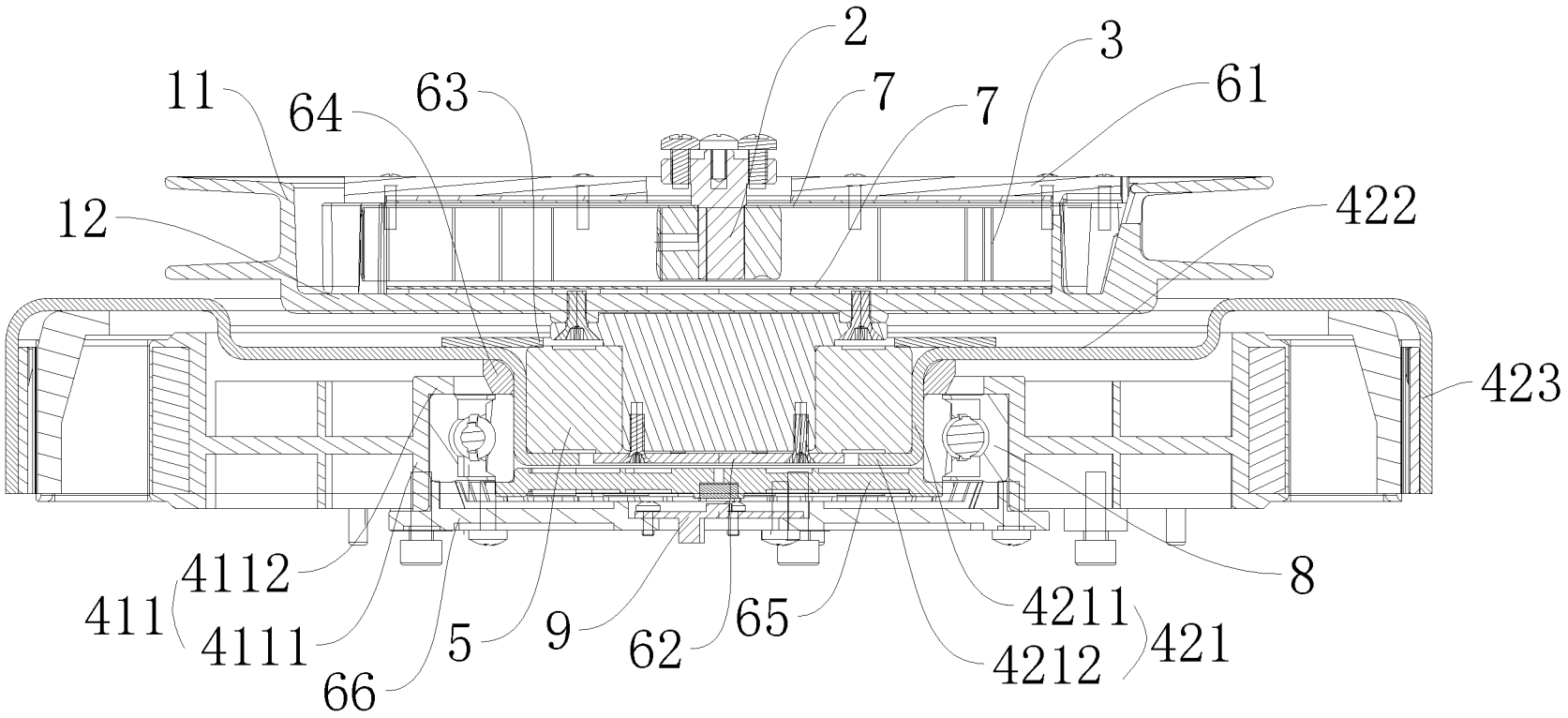
FIG. 5 is a cross-sectional view of FIG. 1.

Referring to FIG. 2 and FIG. 5, the cord reel 1 includes a winding ring 11 and a cord reel body 12. The accommodating slot is arranged inside the winding ring 11, and a winding slot 111 is arranged on an outer circumferential wall of the winding ring 11. The winding slot 111 has an outward opening, and the winding slot 111 provides a position for winding the pull rope and can fix the position of the resistance band to avoid scattering. The cord reel body 12 is connected to one side of the winding ring 11 close to the disk motor 4, which improves the structural strength of the winding ring 11.

The accommodating slot has an opening on one side away from the disk motor 4. The resistance device further includes a cover plate 61. The cover plate 61 is covered at the opening of the accommodating slot and is detachably connected to the cord reel 1. By the detachable cover plate 61, it is convenient to mount the coil spring 3 in the accommodating slot. In this embodiment, the cover plate 61 is detachably connected to one side of the winding ring 11 away from the disk motor 4.

The resistance device further includes two smooth sheets 7. The smooth sheets 7 are arranged in the accommodating slot; the smooth sheet are provided two, and respectively arranged on two sides of the coil spring 3. The smooth sheets 7 have low frictional resistance, and the coil spring 3 is in contact with the smooth sheets 7 during curling and releasing, which can reduce the frictional resistance and reduce noise generated by the coil spring 3. A space between the two smooth sheets 7 is slightly greater than a thickness of the coil spring 3, which can limit a trajectory of deformation of the coil spring 3. By the detachable cover plate 61, it is also convenient to mount the smooth sheets 7 in the accommodating slot.

The smooth sheets 7 can be made of polytetrafluoroethylene. The polytetrafluoroethylene not only has low frictional resistance, but also has certain flexibility. When there is a radial movement of the coil spring 3 in a deformation process due to manufacturing and assembling errors of the coil spring 3, the smooth sheets 7 can be compressed due to their flexibility, so as to adapt to the movement of the coil spring 3, making the deformation process of the coil spring 3 more stable.

Referring to FIG. 5, the connector 5 is a one-way bearing. The one-way earing includes an outer ring and an inner ring. In this embodiment, the one-way bearing is configured to: prevent the inner ring of the one-way bearing from rotating forward relative to the outer ring of the one-way bearing, and allows the inner ring of the one-way bearing to rotate reversely relative to the outer ring of the one-way bearing. The cord reel 1 is connected to the inner ring of the one-way bearing and can rotate synchronously with the inner ring of the one-way bearing. The rotor 42 is connected to the outer ring of the one-way bearing and can rotate synchronously with the outer ring of the one-way bearing.

In other embodiments, the one-way bearing can also be configured to: prevent the outer ring of the one-way bearing from rotating forward relative to the inner ring of the one-way bearing, and allows the outer ring of the one-way bearing to rotate reversely relative to the inner ring of the one-way bearing. The cord reel 1 is connected to the outer ring of the one-way bearing and can rotate synchronously with the outer ring of the one-way bearing. The rotor 42 is connected to the inner ring of the one-way bearing and can rotate synchronously with the inner ring of the one-way bearing.

The rotor 42 includes a first mounting part 421, and a first mounting groove is arranged on the first mounting part 421. The one-way bearing is arranged in the first mounting groove, and the outer ring of the one-way bearing can rotate synchronously with the rotor 42. The resistance device further includes a rotating shaft. The rotating shaft is fixedly connected to one side of the cord reel 1 close to the disk motor 4. The rotating shaft is inserted into the inner ring of the one-way bearing and can rotate synchronously with the inner ring of the one-way bearing. The way of achieving synchronous rotation between the outer ring of the one-way bearing and the rotor 42 can be that the outer ring of the one-way bearing has a first insertion slot that extends in the axial direction; the rotor 42 is fixedly connected to a first insertion strip that extends in the axial direction; and the first insertion strip is inserted into the first insertion slot. The way of achieving synchronous rotation between the rotating shaft and the inner ring of the one-way bearing can be that the inner ring of the one-way bearing has a second insertion slot that extends in the axial direction; the rotating shaft is fixedly connected to a second insertion strip that extends in the axial direction; and the second insertion strip is inserted into the second insertion slot. In this embodiment, the rotating shaft is fixedly connected to one side of the cord reel body 12 close to the disk motor 4.

Figure 3:
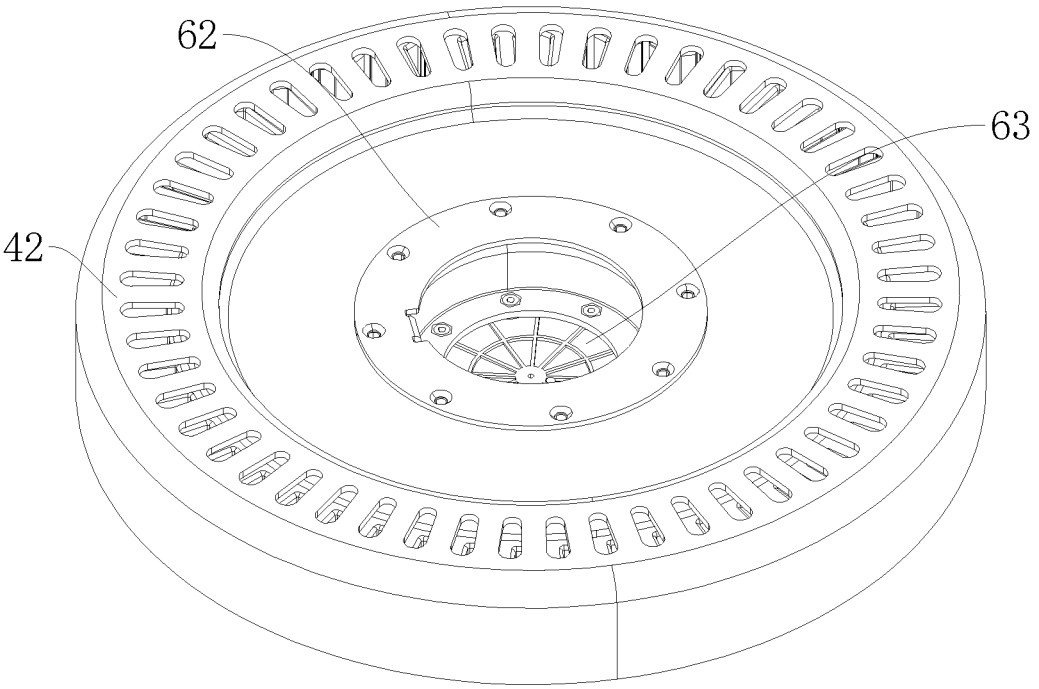
FIG. 3 is a schematic structural diagram of a disk motor part in FIG. 1.

Referring to FIG. 2 and FIG. 3, and in combination with FIG. 5, the rotating shaft is a stepped shaft. The resistance device further includes a first clamping plate 62. The first clamping plate 62 is detachably connected to one side of the stepped shaft away from the cord reel 1, and the inner ring of the one-way bearing is clamped between the first clamping plate 62 and a step surface of the rotating shaft. The first mounting part 421 includes a first ferrule 4211 and a first supporting ring 4212. The first ferrule 4211 is internally provided with the first mounting groove. The first supporting ring 4212 is connected to one side of the first ferrule 4211 away from the cord reel 1. The resistance device further includes a first clamping ring 63. The first clamping ring 63 is detachably connected to one side of the first ferrule 4211 close to the cord reel 1, and the outer ring of the one-way bearing is clamped between the first clamping ring 63 and the first supporting ring 4212. The inner ring of the one-way bearing is clamped by the first clamping plate 62 and the step surface of the rotating shaft, and the outer ring of the one-way bearing is clamped by the first clamping ring 63 and the first supporting ring 4212, so that the one-way bearing is mounted more stably, and movement of the one-way bearing is avoided.

The resistance device further includes the rotary bearing 8. The rotary bearing 8 sleeves the first mounting part 421, and an inner ring of the rotary bearing 8 can rotate synchronously with the first mounting part 421. The stator 41 includes a second mounting part 411, and the second mounting part 411 is internally provided with a second mounting groove; the second mounting part 411 sleeves the rotary bearing 8 through the second mounting groove; and the second mounting part 411 can rotate synchronously with an outer ring of the rotary bearing 8. Through the rotary bearing 8, the rotor 42 can rotate more smoothly relative to the stator 41.

The rotor 42 further includes a main body part 422. The main body part 422 is connected to one side of the first mounting part 421 close to the cord reel 1. The resistance device further includes a second clamping ring 64 and a second clamping plate 65. The second clamping ring 64 sleeves the first mounting part 421 and is supported on the main body part 422. The second clamping plate 65 is detachably connected to one side of the first mounting part 421 away from the cord reel 1, and the inner ring of the rotary bearing 8 is clamped between the second clamping plate 65 and the second clamping ring 64. The second mounting part 411 includes a second ferrule 4111 and a second supporting ring 4112. The second ferrule 4111 is internally provided with the second mounting groove. The second supporting ring 4112 is connected to one side of the second ferrule 4111 close to the cord reel 1. The resistance device further comprises a third clamping plate 66. The third clamping plate 66 is detachably connected to one side of the second ferrule 4111 away from the cord reel 1; and the outer ring of the rotary bearing 8 is clamped between the third clamping plate 66 and the second supporting ring 4112. The inner ring of the rotary bearing 8 is clamped by the second clamping plate 65 and the second clamping ring 64, and the outer ring of the rotary bearing 8 is clamped by the third clamping plate 66 and the second supporting ring 4112, so that the rotary bearing 8 is mounted more stably, and movement of the rotary bearing 8 is avoided.

The rotor 42 also includes a mounting ring 423. The mounting ring 423 is coaxial with the first ferrule 4211. The first ferrule 4211 is connected to an inner side of the main body part 422, and the mounting ring 423 is connected to an outer side of the main body part 422. A plurality of pieces of magnetic steel are arranged at circumferential intervals on an inner side surface of the mounting ring 423. The stator 41 is arranged on one side of the main body part 422 away from the cord reel 1, and is disposed between the first ferrule 4211 and the mounting ring 423. A plurality of winding posts are arranged at circumferential intervals on the stator 41, and coils are wound on the winding posts.

Figure 4:
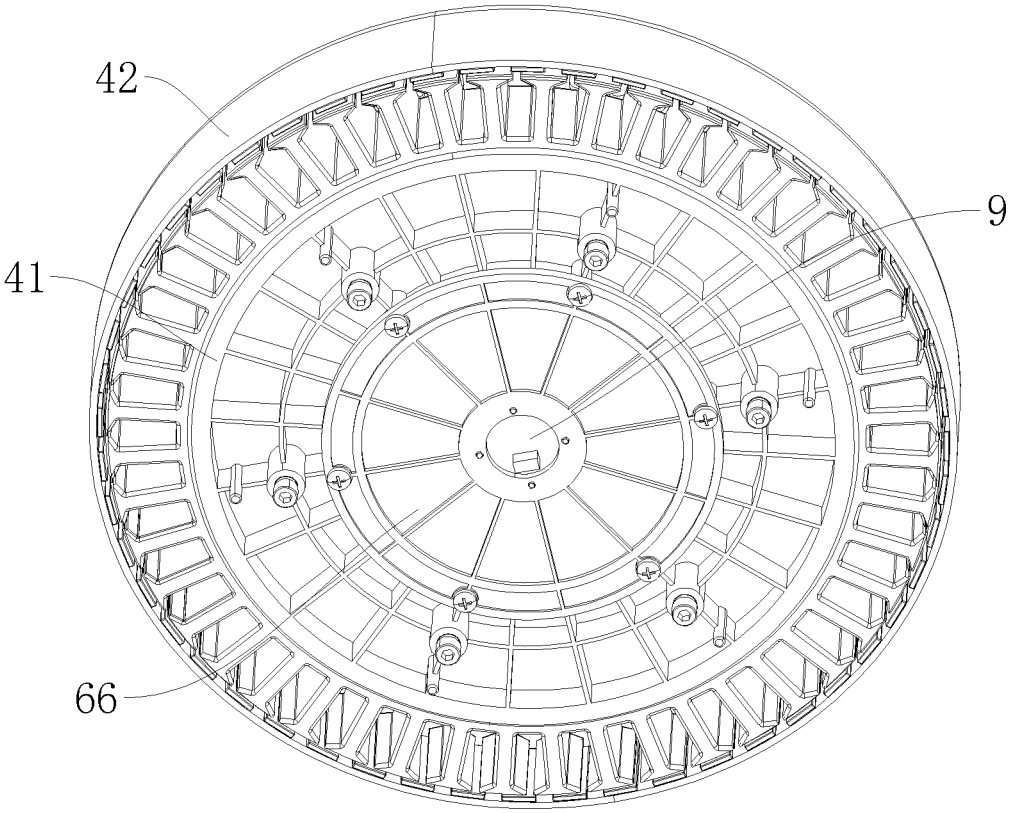
FIG. 4 is a schematic structural diagram of FIG. 3 in another angle.

Referring to FIG. 4 and FIG. 5, the resistance device further includes an encoder 9. An encoder stator is connected to the third clamping plate 66, and an encoder rotor is connected to the second clamping plate 65. The encoder rotor can rotate synchronously with the rotor 42 of the disk motor 4. The encoder 9 is configured to measure a rotation angle of the rotor 42.

Referring to FIG. 1 to FIG. 5, a pull rope type strength training weight module according to an embodiment of the present disclosure includes the resistance device of any one of the above embodiments. A space occupied by the resistance device can be reduced, the service life of the disk motor 4 can be prolonged, and band coiling can also be achieved in case of a power failure. Other advantages of the pull rope type strength training weight module can be referred to the embodiments of the resistance device mentioned above.

The pull rope type strength training weight module can be assembled on a pull rope type strength training aid and replaces a traditional counterweight. A resistance value of the pull rope can be adjusted by changing a torsion of the disk motor, and the resistance value can be infinitely adjusted, making the adjustment more flexible and precise. The problems of insufficient flexibility in resistance adjustment and inability to finely adjust the resistance value are caused by a fixed weight of each traditional counterweight are solved. The pull rope type strength training weight module further includes a control module, an acquisition module, and a communication module. The control module is configured to control the disk motor 4, such as controlling start and stop of the rotor 42 and controlling a torque of the rotor 42 to achieve gear shifting of the resistance. The acquisition module is configured to acquire motion data, such as a currently set resistance magnitude and motion duration. The communication module is in signal connection to the control module and the acquisition module, and is configured to establish communication with an intelligent terminal. The intelligent terminals can be a control instrument, a mobile phone, a computer, or the like. The communication module can display a gear of the resistance and the motion duration on the intelligent terminal, and can also adjust the resistance magnitude and a motion mode through the intelligent terminal. The communication connection established between the communication module and the intelligent terminal can be wired or wireless. The wireless connection includes but is not limited to WIFI, Bluetooth, and the like.

A user inputs a set resistance value through the intelligent terminal and sends the set resistance value to the control module through the communication module. The control module changes the torque by changing the current of the disk motor, to achieve the gear shifting of the resistance. This has the characteristics of easy operation, flexible resistance adjustment, high resistance adjustment accuracy, and the like, and can meet the more refined fitness needs of the user.

Although the present disclosure has been described with reference to several typical implementations, it should be understood that the terms used are illustrative and exemplary rather than restrictive. Since the present disclosure can be implemented in various forms without departing from the spirit or essence of the present disclosure, it should be understood that the above implementations are not limited to any of the aforementioned details, but should be widely interpreted within the spirit and scope limited by the accompanying claims. Therefore, all changes and modifications falling within the scope of the claims or their equivalent scopes should be covered by the accompanying claims.

What is claimed is:

1. A resistance device, comprising:

a cord reel, wherein an accommodating slot is arranged in the cord reel, and the cord reel is configured to wind cord;

a fixed shaft, arranged in the accommodating slot, and the fixed shaft is fixedly arranged;

a coil spring, arranged in the accommodating slot and surrounding the fixed shaft, wherein one end of the coil spring is connected to the cord reel, and the other end of the coil spring is connected to the fixed shaft;

a disk motor, arranged on one axial side of the cord reel, and the disk motor comprises a stator and a rotor;

a connector, connected to the cord reel and the rotor, wherein the connector prevents the cord reel from rotating forward relative to the rotor and allows the cord reel to rotate reversely relative to the rotor.

2. The resistance device according to claim 1, wherein the connector is a one-way bearing.

3. The resistance device according to claim 2, wherein the rotor comprises a first mounting part, and a first mounting groove is arranged on the first mounting part;

the one-way bearing is arranged in the first mounting groove, and an outer ring of the one-way bearing is able to rotate synchronously with the rotor;

the resistance device further comprises a rotating shaft;

the rotating shaft is fixedly connected to one side of the cord reel close to the disk motor;

the rotating shaft is inserted into an inner ring of the one-way bearing and is able to rotate synchronously with the inner ring of the one-way bearing.

4. The resistance device according to claim 3, wherein the rotating shaft is a stepped shaft;

the resistance device further comprises a first clamping plate;

the first clamping plate is detachably connected to one side of the stepped shaft away from the cord reel, and the inner ring of the one-way bearing is clamped between the first clamping plate and a step surface of the rotating shaft;

the first mounting part comprises a first ferrule and a first supporting ring;

the first ferrule is internally provided with the first mounting groove;

the first supporting ring is connected to one side of the first ferrule away from the cord reel;

the resistance device further comprises a first clamping ring; and the first clamping ring is detachably connected to one side of the first ferrule close to the cord reel, and the outer ring of the one-way bearing is clamped between the first clamping ring and the first supporting ring.

5. The resistance device according to claim 3, wherein the resistance device further comprises a rotary bearing;

the rotary bearing sleeves the first mounting part, and an inner ring of the rotary bearing is able to rotate synchronously with the first mounting part;

the stator comprises a second mounting part, and the second mounting part is internally provided with a second mounting groove; the second mounting part sleeves the rotary bearing through the second mounting groove; and the second mounting part is able to rotate synchronously with an outer ring of the rotary bearing.

6. The resistance device according to claim 5, wherein the rotor further comprises a main body part;

the main body part is connected to one side of the first mounting part close to the cord reel;

the resistance device further comprises a second clamping ring and a second clamping plate;

the second clamping ring sleeves the first mounting part and is supported on the main body part;

the second clamping plate is detachably connected to one side of the first mounting part away from the cord reel, and the inner ring of the rotary bearing is clamped between the second clamping plate and the second clamping ring;

the second mounting part comprises a second ferrule and a second supporting ring;

the second ferrule is internally provided with the second mounting groove;

the second supporting ring is connected to one side of the second ferrule close to the cord reel;

the resistance device further comprises a third clamping plate;

the third clamping plate is detachably connected to one side of the second ferrule away from the cord reel; and the outer ring of the rotary bearing is clamped between the third clamping plate and the second supporting ring.

7. The resistance device according to claim 1, wherein the accommodating slot has an opening on one side away from the disk motor;

the resistance device further comprises a cover plate; and the cover plate is covered at the opening of the accommodating slot and is detachably connected to the cord reel.

8. The resistance device according to claim 1, wherein the resistance device further comprises two smooth sheets;

the smooth sheets are arranged in the accommodating slot; the smooth sheets are provided two, and respectively arranged on two axial sides of the coil spring.

9. A pull rope type strength training weight module, comprising the resistance device according to claim 1.

10. The pull rope type strength training weight module according to claim 9, wherein the connector is a one-way bearing.

11. The pull rope type strength training weight module according to claim 10, wherein the rotor comprises a first mounting part, and a first mounting groove is arranged on the first mounting part;

the one-way bearing is arranged in the first mounting groove, and an outer ring of the one-way bearing is able to rotate synchronously with the rotor;

the resistance device further comprises a rotating shaft;

the rotating shaft is fixedly connected to one side of the cord reel close to the disk motor;

the rotating shaft is inserted into an inner ring of the one-way bearing and is able to rotate synchronously with the inner ring of the one-way bearing.

12. The pull rope type strength training weight module according to claim 11, wherein the rotating shaft is a stepped shaft;

the resistance device further comprises a first clamping plate;

the first clamping plate is detachably connected to one side of the stepped shaft away from the cord reel, and the inner ring of the one-way bearing is clamped between the first clamping plate and a step surface of the rotating shaft;

the first mounting part comprises a first ferrule and a first supporting ring;

the first ferrule is internally provided with the first mounting groove;

the first supporting ring is connected to one side of the first ferrule away from the cord reel;

the resistance device further comprises a first clamping ring; and the first clamping ring is detachably connected to one side of the first ferrule close to the cord reel, and the outer ring of the one-way bearing is clamped between the first clamping ring and the first supporting ring.

13. The pull rope type strength training weight module according to claim 11, wherein the resistance device further comprises a rotary bearing;

the rotary bearing sleeves the first mounting part, and an inner ring of the rotary bearing is able to rotate synchronously with the first mounting part;

the stator comprises a second mounting part, and the second mounting part is internally provided with a second mounting groove; the second mounting part sleeves the rotary bearing through the second mounting groove; and the second mounting part is able to rotate synchronously with an outer ring of the rotary bearing.

14. The pull rope type strength training weight module according to claim 13, wherein the rotor further comprises a main body part;

the main body part is connected to one side of the first mounting part close to the cord reel;

the resistance device further comprises a second clamping ring and a second clamping plate;

the second clamping ring sleeves the first mounting part and is supported on the main body part;

the second clamping plate is detachably connected to one side of the first mounting part away from the cord reel, and the inner ring of the rotary bearing is clamped between the second clamping plate and the second clamping ring;

the second mounting part comprises a second ferrule and a second supporting ring;

the second ferrule is internally provided with the second mounting groove;

the second supporting ring is connected to one side of the second ferrule close to the cord reel;

the resistance device further comprises a third clamping plate;

the third clamping plate is detachably connected to one side of the second ferrule away from the cord reel; and the outer ring of the rotary bearing is clamped between the third clamping plate and the second supporting ring.

15. The pull rope type strength training weight module according to claim 10, wherein the pull rope type strength training weight module further comprises a control module, an acquisition module, and a communication module;

the control module is configured to control the disk motor;

the acquisition module is configured to acquire motion data; and the communication module is in signal connection to the control module and the acquisition module, and is configured to establish communication with an intelligent terminal.

16. The pull rope type strength training weight module according to claim 9, wherein the accommodating slot has an opening on one side away from the disk motor;

the resistance device further comprises a cover plate; and the cover plate is covered at the opening of the accommodating slot and is detachably connected to the cord reel.

17. The pull rope type strength training weight module according to claim 16, wherein the pull rope type strength training weight module further comprises a control module, an acquisition module, and a communication module;

the control module is configured to control the disk motor;

the acquisition module is configured to acquire motion data; and the communication module is in signal connection to the control module and the acquisition module, and is configured to establish communication with an intelligent terminal.

18. The pull rope type strength training weight module according to claim 9, wherein the resistance device further comprises two smooth sheets;

the smooth sheets are arranged in the accommodating slot; the smooth sheets are provided two, and respectively arranged on two axial sides of the coil spring.

19. The pull rope type strength training weight module according to claim 18, wherein the pull rope type strength training weight module further comprises a control module, an acquisition module, and a communication module;

the control module is configured to control the disk motor;

the acquisition module is configured to acquire motion data; and the communication module is in signal connection to the control module and the acquisition module, and is configured to establish communication with an intelligent terminal.

20. The pull rope type strength training weight module according to claim 9, wherein the pull rope type strength training weight module further comprises a control module, an acquisition module, and a communication module;

the control module is configured to control the disk motor;

the acquisition module is configured to acquire motion data; and the communication module is in signal connection to the control module and the acquisition module, and is configured to establish communication with an intelligent terminal.

* * * * *